US008680464B2

(12) United States Patent
Hashimoto et al.

(10) Patent No.: US 8,680,464 B2
(45) Date of Patent: Mar. 25, 2014

(54) MASS SPECTROMETER

(75) Inventors: Yuichiro Hashimoto, Tachikawa (JP); Hideki Hasegawa, Tachikawa (JP); Masuyuki Sugiyama, Hino (JP); Hidetoshi Morokuma, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 90 days.

(21) Appl. No.: 13/085,761

(22) Filed: Apr. 13, 2011

(65) Prior Publication Data

US 2011/0253891 A1 Oct. 20, 2011

(30) Foreign Application Priority Data

Apr. 19, 2010 (JP) ..... 2010-095617

(51) Int. Cl.
*H01J 49/26* (2006.01)
*H01J 49/04* (2006.01)

(52) U.S. Cl.
USPC ..... 250/289; 250/282; 250/288; 250/290; 250/293

(58) Field of Classification Search
USPC ..... 250/281, 282, 287–293
See application file for complete search history.

(56) References Cited

U.S. PATENT DOCUMENTS

| | | | | |
|---|---|---|---|---|
| 5,955,731 | A * | 9/1999 | Bergmann et al. | 250/288 |
| 5,977,541 | A * | 11/1999 | Miyazawa et al. | 250/288 |
| 6,504,150 | B1 * | 1/2003 | Verentchikov et al. | 250/286 |
| 6,707,035 | B2 * | 3/2004 | Hughey et al. | 250/288 |
| 6,723,286 | B2 * | 4/2004 | Sakairi et al. | 250/287 |
| 6,734,423 | B2 * | 5/2004 | Bryden | 250/288 |
| 6,768,108 | B2 * | 7/2004 | Hirano et al. | 250/288 |
| 6,828,550 | B2 | 12/2004 | Griffey et al. | |
| 7,230,234 | B2 | 6/2007 | Kobayashi | |
| 7,592,589 | B2 | 9/2009 | Hashimoto et al. | |
| 8,242,186 | B2 * | 8/2012 | Nagahata et al. | 522/84 |
| 2002/0110490 | A1 * | 8/2002 | Sakairi et al. | 422/68.1 |
| 2003/0006369 | A1 * | 1/2003 | Bryden | 250/281 |
| 2004/0169139 | A1 * | 9/2004 | Sakairi et al. | 250/288 |

(Continued)

FOREIGN PATENT DOCUMENTS

| | | |
|---|---|---|
| JP | 10-012188 A | 1/1998 |
| JP | 2004-516490 A | 6/2004 |

(Continued)

OTHER PUBLICATIONS

A. Keil et al., Ambient Mass Spectrometry with a Handheld Mass Spectrometer at High Pressure, Analytical Chemistry, vol. 79, No. 20, Oct. 15, 2007, pp. 7734-7739.

(Continued)

*Primary Examiner* — Bernard E Souw
(74) *Attorney, Agent, or Firm* — Mattingly & Malur, PC

(57) ABSTRACT

A mass spectrometer having a resolution improved by introducing ions into a mass spectrometry part with a high efficiency is provided with a small-sized, simple configuration. The mass spectrometer includes an opening/closing mechanism provided between a sample introducing piping part for introducing a sample into the mass spectrometry part and the mass spectrometry part to conduct gas introduction intermittently and control sample passage. The mass spectrometer further includes a pump mechanism to evacuate a high pressure side of the sample introducing piping part, that is, an opposite side of the opening/closing mechanism to the mass spectrometry part to have a pressure in a range of 100 to 10,000 Pa.

12 Claims, 9 Drawing Sheets

(56) References Cited

U.S. PATENT DOCUMENTS

| | | | | |
|---|---|---|---|---|
| 2006/0159916 | A1* | 7/2006 | Dubrow et al. | 428/357 |
| 2006/0219896 | A1 | 10/2006 | Hashimoto et al. | |
| 2007/0018093 | A1 | 1/2007 | Earm et al. | |
| 2008/0272286 | A1 | 11/2008 | Vestal | |
| 2009/0272893 | A1 | 11/2009 | Hieftje et al. | |
| 2010/0059674 | A1 | 3/2010 | Chen et al. | |
| 2010/0125110 | A1* | 5/2010 | Nagahata et al. | 522/182 |
| 2010/0301209 | A1* | 12/2010 | Ouyang et al. | 250/288 |
| 2011/0210241 | A1 | 9/2011 | Badiei et al. | |
| 2011/0212127 | A1* | 9/2011 | Drew et al. | 424/204.1 |
| 2011/0253889 | A1* | 10/2011 | Ishimaru et al. | 250/282 |
| 2012/0326022 | A1* | 12/2012 | Kumano et al. | 250/282 |
| 2013/0056633 | A1* | 3/2013 | Hashimoto et al. | 250/288 |

FOREIGN PATENT DOCUMENTS

| | | | |
|---|---|---|---|
| JP | 2006-294582 | A | 10/2006 |
| WO | 02/054075 | A1 | 7/2002 |
| WO | 2009/023361 | A2 | 2/2009 |
| WO | 2009031179 | A1 | 3/2009 |

OTHER PUBLICATIONS

Na et al. "Development of a Dielectric Barrier Discharge Ion Source for Ambient Mass Spectrometry", Journal of the Ameican Society for Mass Spectrometry, Elsevier Science Inc, US, vol. 18, No. 10, Sep. 20, 2007, pp. 1859-1862.

* cited by examiner

MASS SPECTROMETER

CLAIM OF PRIORITY

The present application claims priority from Japanese patent application JP 2010-095617 filed on Apr. 19, 2010, the content of which is hereby incorporated by reference into this application.

BACKGROUND OF THE INVENTION

The present invention relates to a mass spectrometer.

A method for introducing ions generated in an atmospheric-pressure or low-vacuum chamber into a mass spectrometry part which requires a high vacuum of $10^{-1}$ Pa or less for mass spectrometry operation in a mass spectrometer is an important technique for implementing a high sensitivity.

In Analytical Chemistry, 2007, 79, 20, 7734-7739, Adam Keil, et al. a method for introducing ions supplied from an atmospheric-pressure ion source directly into the mass spectrometry part using a thin capillary provided between the atmospheric-pressure ion source and a high-vacuum chamber having the mass spectrometry part disposed therein is described. This configuration is the simplest configuration for connecting the atmospheric-pressure ion source and the mass spectrometry part in the high-vacuum chamber.

In U.S. Pat. No. 7,592,589 a differential pumping method used most typically in mass spectrometry is described. According to it, one or more of differential pumping chambers having medium pressures are disposed between an atmospheric-pressure ion source and a vacuum chamber having a mass spectrometry part disposed therein and respective chambers are evacuated by different vacuum pumps. As a result, it is possible to introduce ions generated at the atmospheric pressure remarkably efficiently as compared with one in Analytical Chemistry, 2007, 79, 20, 7734-7739, Adam Keil, et al.

In WO 2009/023361 a method of connecting an atmospheric-pressure ion source and a high-vacuum chamber having a mass spectrometry part disposed therein through a capillary, installing a pulse valve in between, and controlling opening/closing timewise is described. When the pulse valve is open, ions generated at the atmospheric pressure are introduced into the mass spectrometry part in the high-vacuum chamber. Then, the pulse valve is closed. After the pressure in the high-vacuum chamber is decreased, the mass spectrometry part is operated. As a result, it becomes possible to increase the amount of introduced ions by a large amount compared with one in Analytical Chemistry, 2007, 79, 20, 7734-7739, Adam Keil, et al. even in the case where a similar vacuum pump is used.

In U.S. Pat. No. 7,230,234 a method of installing a shutter-style pulse valve between an ion source disposed in a medium vacuum or a high vacuum of $5\times10^{-2}$ Pa or less and a high-vacuum chamber having a time-of-flight type mass spectrometer disposed therein is described. According to this method, degradation of the time-of-flight type mass spectrometry part can be improved by controlling a flow of ions which flow into the high-vacuum chamber.

In U.S. Pat. No. 6,828,550 a shutter for introducing ions generated at the atmospheric pressure into an ion trap (described as ion reservoir) disposed in a medium-vacuum or high-vacuum chamber of $10^{-2}$ Pa or less in a pulsed manner is described. A shutter for controlling the ejection and injection in a pulsed manner when ions are accumulated in the ion trap disposed in the middle-vacuum or high-vacuum chamber of $10^{-2}$ Pa or less and introduced into a mass spectrometry part in the high-vacuum chamber is also described.

SUMMARY OF THE INVENTION

In a mass spectrometer in which an ion source is disposed in an atmospheric-pressure or low-vacuum chamber, the transmission efficiency of ions from the ion source to the mass spectrometry part is a great factor to determine the overall sensitivity. Since the transmission efficiency of ions is nearly proportional to the amount of introduced gas at the time of ion introduction, it is necessary for maintaining the sensitivity to increase the amount of gas introduced into the vacuum. On the other hand, in order to implement a portable, small-sized mass spectrometer, it is indispensable to use a small-sized evacuation pump having a small pumping speed or to decrease the number of evacuation pumps. One of objects of the present invention is to maintain the sensitivity for a long time by decreasing the total flow amount of gas which flows into high vacuum and reducing contamination even when a pump having a small pumping speed necessary for size reduction is used.

According to the technique disclosed in Analytical Chemistry, 2007, 79, 20, 7734-7739, Adam Keil, et al., gas from the atmospheric-pressure ion source is introduced directly to the high-vacuum chamber having the mass spectrometry part disposed therein using the capillary and the amount of gas which can be introduced is remarkably small. Consequently, the transmission efficiency of ions and sensitivity decrease. Furthermore, since it is necessary to make the conductance of the capillary between the atmospheric-pressure ion source and the high-vacuum chamber small, there is also a problem that the capillary tends to be clogged.

According to U.S. Pat. No. 7,592,589, the flow amount of gas introduced into the high-vacuum chamber is increased by using one or more of differential pumping chambers between the high-vacuum chamber having the mass spectrometer disposed therein and the atmospheric-pressure ion source. However, vacuum pumps to evacuate differential pumping chambers respectively are additionally needed.

According to WO 2009/023361, opening/closing between capillaries is conducted using a pinch valve. While a pinch valve has a small dead volume, since silicon rubber is used in its movable part, there are problems such as being difficult to heat, great influence of contamination, and degrading seal performance remarkably by adhesion of dust. Furthermore, since the pressure before the valve is the atmospheric pressure ($10^5$ Pa) and the pressure behind the valve is $10^{-1}$ Pa or less, there is a pressure ratio as large as $10^6$. Therefore, the restriction of the leak rate with opening/closing of the valve is very stringent, resulting in a problem of short life of the valve.

In U.S. Pat. No. 7,230,234, there is no description concerning the connection between the atmospheric-pressure ion source or the low-vacuum ion source and the mass spectrometry part. Furthermore, if one of the above-described method is used for connection between the atmospheric-pressure ion source or the low-vacuum ion source and the mass spectrometry part, the efficiency of introduction from the ion source to the mass spectrometry part becomes remarkably low or vacuum pumps become large in size, resulting in a problem.

Regarding a valve mechanism between the atmospheric-pressure ion source and the ion trap according to U.S. Pat. No. 6,828,550, a large amount of gas is introduced when the valve is open, and the pressure variation in the high-vacuum chamber having the ion trap disposed therein is great. In addition, dirt from the atmospheric-pressure ion source is directly introduced, resulting in a problem such as contamination of the ion trap. Furthermore, in the same way as WO 2009/023361, the pressure difference between before and behind the valve is great and the restriction of the leak rate of the valve is stringent, resulting in a problem of short life of the valve. Furthermore, as for the valve between the ion trap and the mass spectrometry part, when one of the above-described methods is used for the connection between the atmospheric-pressure ion source or a low-vacuum ion source and the mass spectrometry part, the efficiency of introduction from the ion source into the mass spectrometry part becomes remarkably low or vacuum pumps become large in size, resulting in a problem in the same way as U.S. Pat. No. 7,230,234.

In order to solve the above-described problems, the mass spectrometer according to the present invention includes: an opening/closing mechanism provided between a sample introducing piping part for introducing a sample into a mass spectrometry part and the mass spectrometry part to intermittently introduce gas and to control sample passage; and a pump mechanism for evacuating to bring the pressure on a high pressure side of the sample introducing piping part, that is, a pressure on an opposite side of the opening/closing mechanism to the mass spectrometry part equal to 100 Pa or greater and equal to 10,000 Pa or less.

According to the present invention, it is possible to introduce ions into the mass spectrometry part with a high efficiency by using a small-sized, simple configuration and the resolution is improved. Furthermore, it is possible to prevent contamination and to improve the durability as well.

Other objects, features, and advantages of the invention will become apparent from the following description of the embodiments of the invention taken in conjunction with the accompanying drawings.

DESCRIPTION OF THE EMBODIMENTS

First Embodiment

Figure 1A:
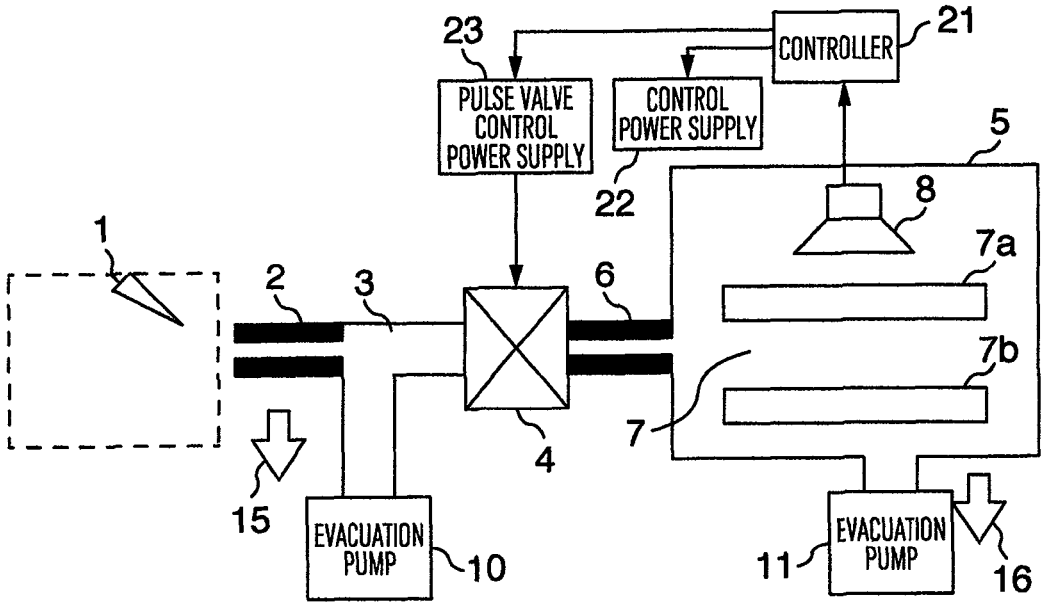
FIGS. 1A and 1B show a first embodiment of the present invention.

FIG. 1A is a configuration diagram of a mass spectrometer according to the present invention. Ions generated in an atmospheric-pressure ion source 1 such as an atmospheric-pressure chemical ion source or an electro-spray ion source pass through a capillary 2 together with gas and are introduced into a pre-valve evacuation region 3. The pre-valve evacuation region 3 is evacuated to approximately 100 to 10,000 Pa by an evacuation pump 10 comprising a diaphragm pump, a rotary pump, or the like. (An evacuation direction of the evacuation pump is indicated as 15.)

The pressure of the pre-valve evacuation region 3 is set to 100 to 10,000 Pa for the following reason. One of objects of the present invention is to make the pressure ratio between before and behind the valve small and to mitigate the restriction of the leak rate on the valve. For this purpose, it is necessary that the pressure before the valve is sufficiently small compared with the atmospheric pressure of 100,000 Pa. In order to achieve this object, therefore, it is desirable to set the upper limit pressure equal to 10,000 Pa or less allowing a leak rate of a pressure ratio of 1/10 to a convention. On the other hand, the lower limit pressure is set for the following reason. In a pulse valve 4 which opens/closes in a pulsed manner, operation is made fast by reducing the dead volume and shortening the valve drive distance. Therefore, ions and gas pass through a narrow gap of approximately 0.1 to 1 mm. For ions to pass through the gap with high efficiency, ions need to be introduced without colliding with the wall face of the gap while following the flow of gas. For judging the degree of following, Knudsen number indicated by Expression 1 is considered as an index.

$$K_n=\lambda/L \qquad \text{(Expression 1)}$$

Here, $\lambda$(m) is a mean free path of ions and L(m) is a representative length (which is in this case a minimum distance between gaps). Supposing that the collision cross section of ions is 1 $nm^2$, the mean free path $\lambda$(m) is calculated according to Expression 2 at 0° C.

$$\lambda=0.0037/P \qquad \text{(Expression 2)}$$

Here, P (Pa) is pressure.

Figure 2:
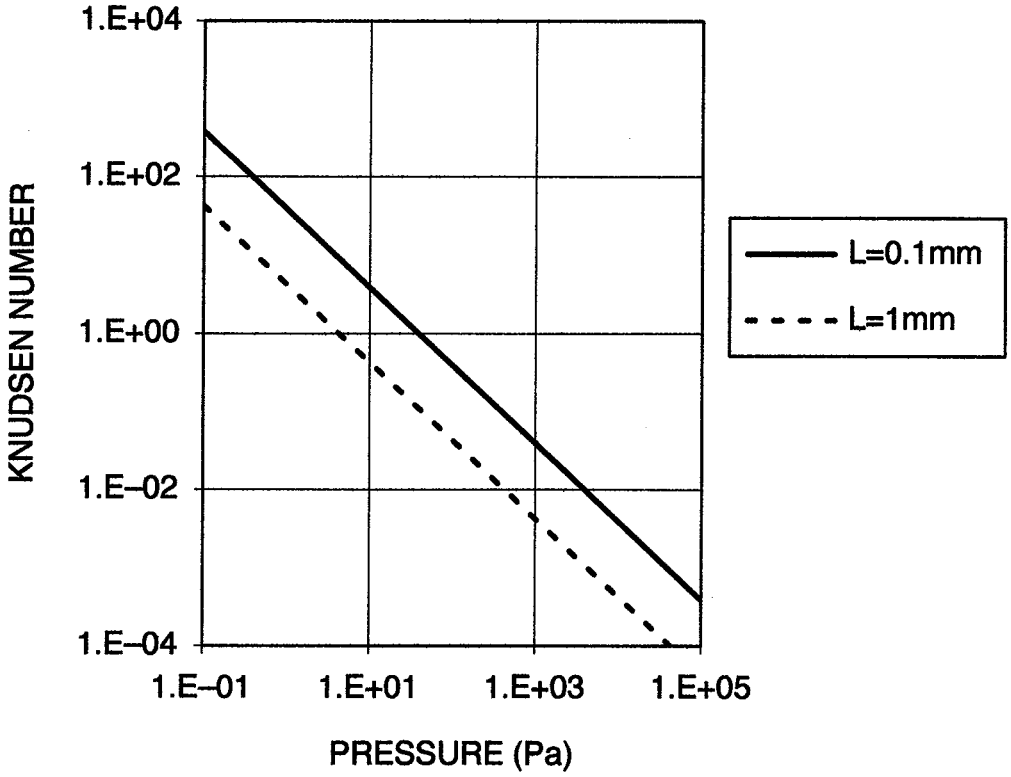
FIG. 2 is a diagram for explaining effects of the first embodiment of the present invention.

The Knudsen numbers when the minimum distance of the gap L=1 mm and 0.1 mm are plotted in FIG. 2. The Knudsen number becomes smaller in inverse proportion to the pressure. When the Knudsen number is sufficiently smaller than 1, collision of ions with gas occurs more frequently than collision with the wall and the ions can move efficiently as a continuous fluid together with a gas flow without colliding with wall faces. The Knudsen number becomes $K_n=1$ when the pressure is approximately 4 Pa at L=1 mm and when the pressure is approximately 40 Pa at L=0.1 mm, respectively. At L=0.25 mm which is a typical inside diameter of a capillary, the Knudsen number becomes $K_n<1$, at which gas and ions can be regarded as a single continuous fluid, when the pressure is 100 Pa or greater. For increasing the transmission efficiency of ions within the valve, therefore, it is desirable to set the pressure of the pre-valve evacuation region 3 equal to approximately 100 Pa or greater. Under such a condition, ions are introduced into the vacuum efficiently by the gas flow. On the basis of consideration described heretofore, the pressure of the pre-valve evacuation region 3 is set in a range of 100 to 10,000 Pa. When the flow path inside the valve is not a linear structure but is complicated, ions flow through a complicated flow path. For avoiding the collision with the wall faces and implementing efficient ion transmission, the gas pressure needs to be increased to approximately ten times (which corresponds to Knudsen number <0.01). In this case, the pressure in the pre-valve evacuation region 3 is set in a range of 1,000 to 10,000 Pa.

The pulse valve 4 is disposed in a stage subsequent to the pre-valve evacuation region 3 and its opening/closing operation is conducted using a pulse valve control power supply 23.

As the pulse valve, a needle valve, a pinch valve, a globe valve, a gate valve, a ball valve, a butterfly valve, a slide valve, or the like is used. When the pulse valve is open, ions and gas which are introduced into the pre-valve evacuation region 3 are introduced into an analyzer 5 having a mass spectrometry part 7 and a detector 8 disposed therein through a capillary 6. The analyzer 5 is evacuated by an evacuation pump 11 comprising a turbo molecular pump, a scroll pump, an oil-diffusion pump, an ion getter pump, or the like. (An evacuation direction of the evacuation pump is indicated as 16.) And ions introduced into the analyzer 5 are introduced into the mass spectrometry part 7.

In the first embodiment, a sequence will be described by taking a linear ion trap mass spectrometer as an example.

Figure 1B:
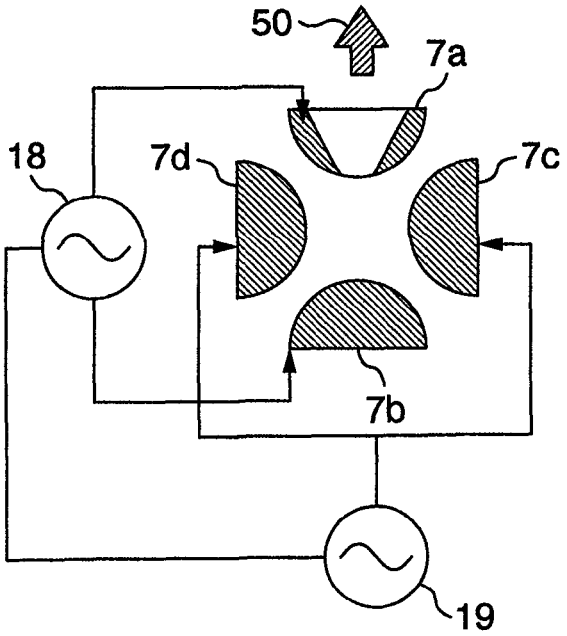

As shown in FIG. 1B, a linear ion trap 7 comprises four quadrupole rod electrodes (7*a*, 7*b*, 7*c*, and 7*d*). A trap RF voltage 19 is applied between adjacent rods. It is known that an optimum value of the trap RF voltage differs according to the electrode size and the measured mass range. Typically, a trap RF voltage having amplitude in the range of 0 to 5 kV (0 to peak) and a frequency in the range of approximately 500 kHz to 5 MHz is used. It is possible to trap ions in a space surrounded by the quadrupole rod electrodes 7*a* to 7*d* by applying this trap RF voltage 19. Furthermore, a supplemental AC voltage 18 is applied between one pair of rod electrodes (7*a* and 7*b*) facing with each other. As the supplemental AC voltage, typically a synthesized waveform having amplitude in the range of 0 to 50 V (0 to peak) and a frequency in the range of approximately 5 kHz to 2 MHz is used. It becomes possible to isolate only ions of a specific mass number from ions trapped within the space surrounded by the quadrupole rod electrodes 7*a* to 7*d* and to exclude the other ions, to dissociate ions having a specific mass number, to conduct mass scan to eject ions mass-selectively, or the like, by applying the supplemental AC voltage 18. The ions ejected mass-selectively (in an ion ejection direction 50) are converted to an electric signal by the detector 8 comprising an electromultiplier, a microchannel plate, a combination of a conversion dynode, a scintillator, and a photomultiplier, or the like. The electric signal is sent to a controller 21 and stored. The controller 21 stores the information and conducts data analysis. Furthermore, the controller 21 has a function of controlling a control power supply 22 which controls respective electrodes and the pulse valve control power supply 23. In FIG. 1A, an example in which the ion source 1 is connected to the pulse valve 4 through the capillary 2 and the pulse valve 4 is connected to the analyzer 5 through the capillary 6 is shown. However, orifices may be used instead of the capillaries. For obtaining the same conductance by using orifices, it is necessary to use small diameters, which may result in a problem of clogging by dust. If orifices are used, however, a compact configuration compared with that with capillaries which are typically in the range of approximately 10 to 50 mm in length is possible.

A pressure of the analyzer 5 becomes 1 Pa or greater (typically approximately 10 Pa) when the pulse valve 4 is open. On the other hand, the linear ion trap 7 and the detector 8 comprising the electromultiplier or the like can operate favorably with a pressure of 0.1 Pa or less. Therefore, measurement is conducted according to a measurement sequence shown in FIG. 3. An MS/MS measurement sequence is comprised by five steps: accumulation, evacuation, isolation, dissociation, and mass scan.

At the accumulation step, ions which have passed through the pulse valve are accumulated within the trap by applying the trap RF voltage. A time period of the accumulation step over which the valve is open is in the range of approximately 1 to 50 ms. As the time period of the accumulation step is longer, the amount of ions introduced into the mass spectrometry part increases and an advantage of an improved sensitivity rises while the pressure in the analyzer 5 becomes high and there is a possibility that load of the evacuation pump 11 will increase, contamination component and the like from the ion source 1 will be introduced into the analyzer 5, or the like. During the accumulation, the pressure in the analyzer 5 which is close to vacuum increases and a high voltage applied to the detector 8 is turned off.

Figure 4A:
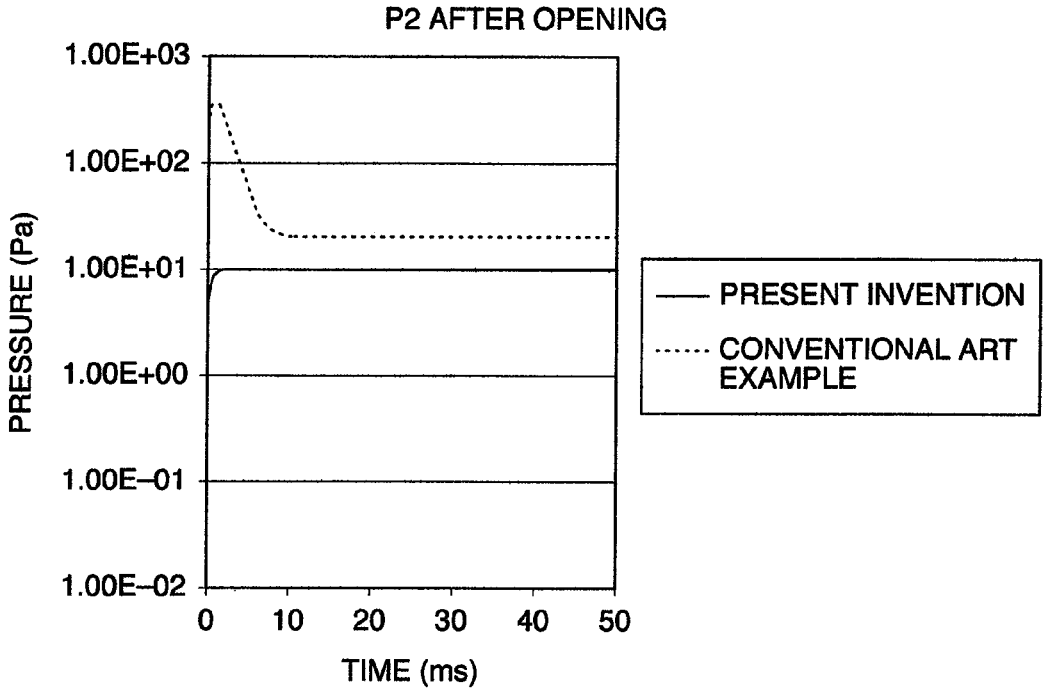
FIGS. 4A to 4D are diagrams for explaining effects of the first embodiment of the present invention.
Figure 4B:
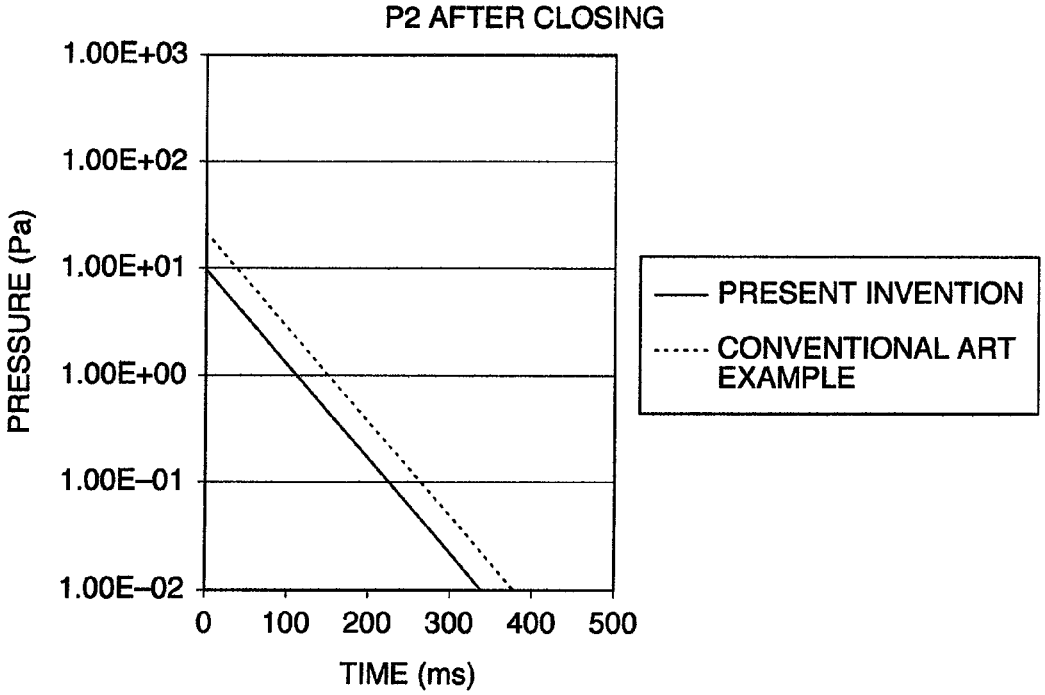
Figure 4C:
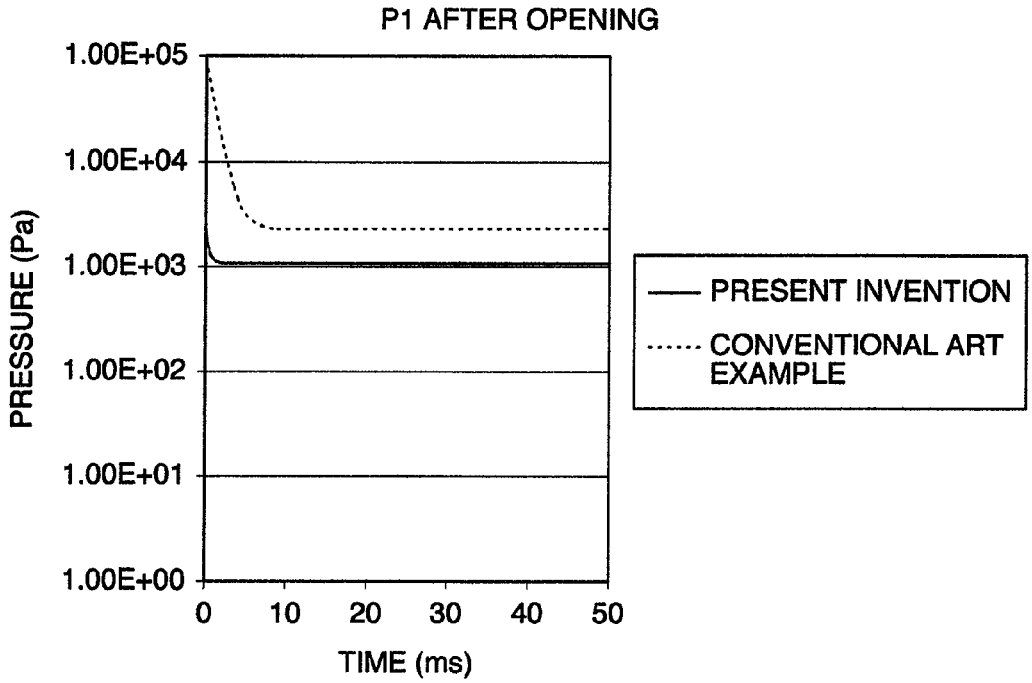

Results obtained by simulating a degree of vacuum P1 in the region 3 located immediately before the pulse valve and a degree of vacuum P2 in the analyzer 5 during the accumulation are shown in FIGS. 4A and 4C. In the simulation, it is assumed that a conductance C1 of the capillary 2 between the ion source 1 and the pre-valve evacuation region 3 is 2 mL/s, a pumping speed S1 of the evacuation pump 10 is 100 mL/s, a volume V1 of the pre-valve evacuation region 3 is 0.1 mL, a conductance C2 of the capillary 6 between the pulse valve 4 and the analyzer 5 is 9 mL/s, a pumping speed S2 of the evacuation pump 11 is 10 L/s, and a volume V2 of the analyzer 5 is 500 mL. As data for comparison calculated values in the case where the differential pumping is not used before the pulse valve in the same way as WO 2009/023361 are also shown in FIGS. 4A to 4D as a conventional art example.

By the way, according to WO 2009/023361, the volume V1 of the pre-valve evacuation region 3 is kept small by using the pinch valve. In the pinch valve, however, silicon rubber is used in its movable part and consequently heating is difficult and there is a problem of contamination. On the other hand, in a globe valve capable of high speed operation, a dead volume exists. As the conventional art example, therefore, the same parameters as those used in the present invention have been used except whether there is the evacuation pump 10.

In the conventional art example, the pressure in the analyzer reaches a high pressure of 100 Pa or greater for several ms after the pulse valve is opened and the pressure stabilizes in approximately 10 ms. On the other hand, in the present invention, the pressure gradually rises and stabilizes in approximately 2 ms (FIG. 4A). This is because in the conventional art example the pressure before the pulse valve rises up to the atmospheric pressure when the valve is closed (FIG. 4B) and the high pressure gas is introduced into the analyzer at the same time as the pulse valve is opened. Since the pressure in the analyzer becomes high temporarily in the conventional art example, various disadvantages such as discharge of an RF voltage applied to the linear ion trap 7 and the like, drop of the trap efficiency in the linear ion trap 7, and degradation of the detector are brought about. According to the present invention, the pressure can be controlled in a low-pressure region and it becomes possible to avoid the disadvantages.

Figure 4D:
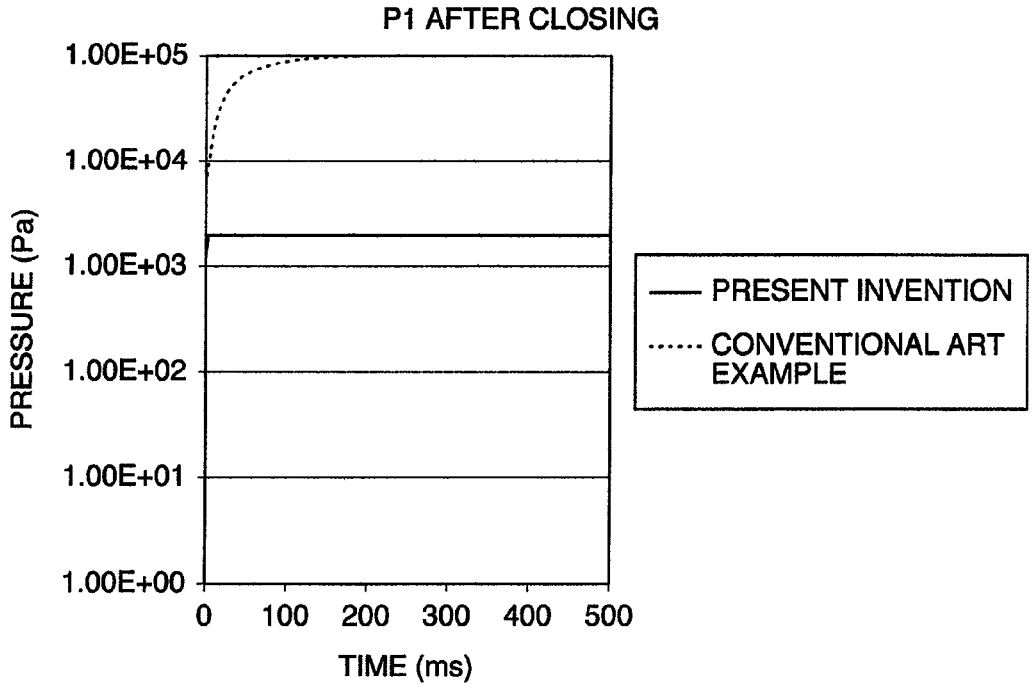

At the evacuation step, operations are conducted in the same way except an operation of closing the pulse valve 4 as the accumulation step. This step is a step of waiting until the pressure in the analyzer 5 becomes 0.1 Pa or less where mass analysis operation is possible. Results obtained by simulating the degree of vacuum P1 in the region 3 located immediately before the pulse valve and the degree of vacuum P2 in the analyzer 5 at the evacuation step are shown in FIGS. 4B and 4D. As for the parameters, the same values as those described above are used. In both cases, it is appreciated that the pressure falls to 0.1 Pa or less in 200 ms to 300 ms and mass spectrometry operation becomes possible. This time can be improved by decreasing the volume of the analyzer 5 or increasing the pumping speed of the evacuation pump 11.

Here, attention should be paid to a ratio (P1/P2) in pressure value between before and behind the valve. When a comparison is made at P2=0.1 Pa, in the conventional art example P1 restores to the atmospheric pressure again and, consequently, the ratio in pressure value becomes approximately $10^6$ while in the present invention a part located immediately before the valve is evacuated and, consequently, the ratio in pressure value becomes approximately $10^4$. In the conventional art example, it is necessary to use a pulse valve which is low in the leak rate in order to maintain a ratio in pressure value as great as $10^6$ and there are many restrictions such as high power consumption, a short life, susceptibility to dust, and a high cost. On the other hand, in the present invention, the restriction on the leak rate is mitigated by one hundred times and the problems described above are solved so that there are advantages such as low power consumption, a long life, robustness, and a low cost.

Figure 3:
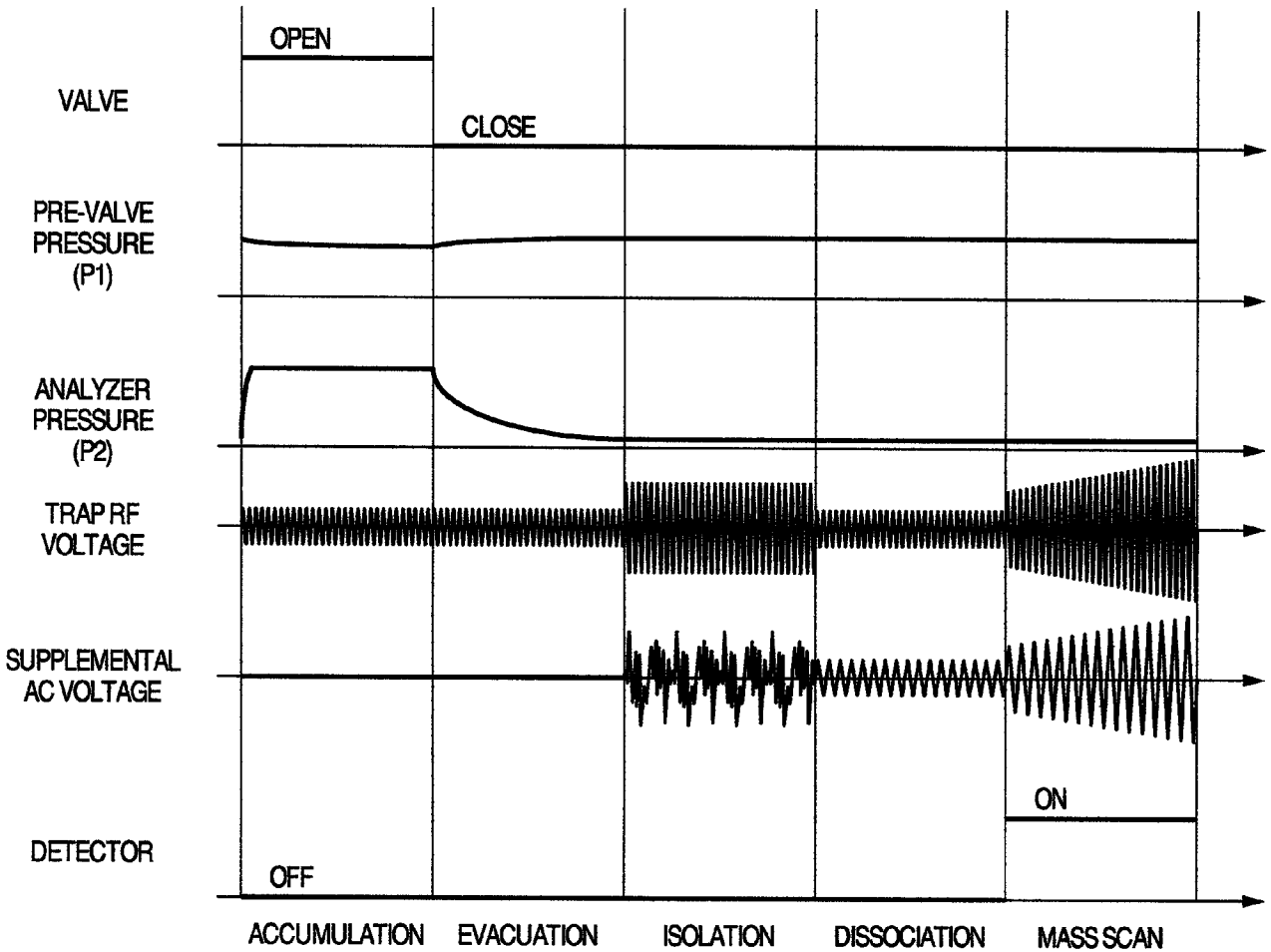
FIG. 3 shows a measurement sequence of the first embodiment of the present invention.

Among ions accumulated within the ion trap lowered in pressure to 0.1 Pa or less at the isolation step, ions other than those having specific mass numbers are excluded and only specific ions are left at the isolation step. A method called FNF (Filtered Noise Field) in which a superposed waveform of a plurality of frequencies is applied as a supplemental AC voltage is shown in FIG. 3. Ions which have resonated by the FNF are ejected to the outside of the ion trap and only specific mass ions remain in the trap. Besides, a similar isolation step can be executed by sweeping the frequency of the supplemental AC voltage or changing the amplitude of the trap RF voltage.

At the dissociation step, specific mass numbers isolated within the ion trap is dissociated by applying the supplemental AC voltage. By multiple collisions between ions which resonate with the supplemental AC voltage and bath gas within the trap, the ions are resolved to generate fragment ions. As for the bath gas, a pressure in the range of approximately 0.01 to 1 Pa is suitable. The gas remaining in the analyzer may be used or it is also possible to introduce gas into the ion trap separately (not illustrated). As for an advantage obtained by introducing the gas separately, it becomes possible to conduct measurement with high reproducibility by controlling the gas pressure with high precision.

At the mass scan step, ions within the ion trap are ejected mass-selectively. A method of changing the amplitude of the trap RF voltage by applying the supplemental AC voltage is shown in FIG. 3. Ions which have resonated by this are ejected successively in order from a lower mass number to a higher mass number and detected by the detector 8. Since the amplitude value of the RF voltage and the mass number of ejected ions are defined uniquely, a mass spectrum can be acquired from the mass number of detected ions and its signal quantity. Besides this, as the method for the mass scan, there is also a method such as for making the amplitude of the trap RF voltage constant and sweeping the frequency of the supplemental AC voltage. During the mass scan, it is necessary to turn on the detector voltage. By the way, since a high voltage which requires a time to stabilize is typically used as the voltage of the detector, the detector voltage may be turned on at the isolation step or the dissociation step.

The MS/MS measurement is conducted at the five steps described heretofore. In the typical MS measurement, however, the isolation step and the dissociation step are omitted. Furthermore, when conducting the MS/MS analysis a plurality of times (MSn), it can be implemented by repeating the isolation step and the dissociation step a plurality of times. Furthermore, in the present embodiment, a detector for which a high voltage cannot be applied in a high pressure region such as an electromultiplier, is supposed. However, it is also possible to omit the switching of the detector voltage by using a photomultiplier, a semiconductor detector, or the like.

Figure 5A:
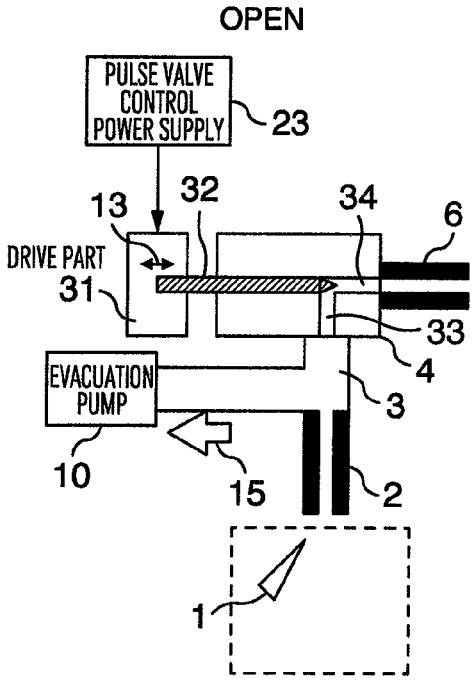
FIGS. 5A and 5B are diagrams for explaining the first embodiment of the present invention.
Figure 5B:
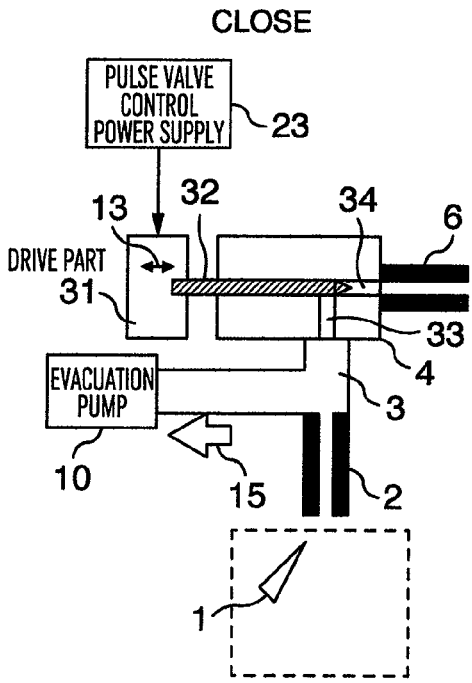

FIGS. 5A and 5B show an example of a valve configuration diagram according to the present invention. A configuration of the analyzer 5 and its subsequent components are the same as that shown in FIG. 1 and omitted. In FIGS. 5A and 5B, a bidirectional globe valve suitable for fast opening/closing operation is used as the pulse valve. A movable seal part 32 is moved in a direction indicated by an arrow 13 in a movable space by a drive part 31 comprising a solenoid or the like. FIG. 5A shows a state when the valve is open and a valve-inlet side piping 33 and a mass-spectrometry-part side piping 34 are connected. FIG. 5B shows a state when the valve is closed and the valve-inlet side piping 33 is blocked from the mass-spectrometry-part side piping 34. When a solenoid is used in the drive part 31, the power consumption can be reduced by setting to close the valve when a voltage is not applied.

Second Embodiment

Figure 6A:
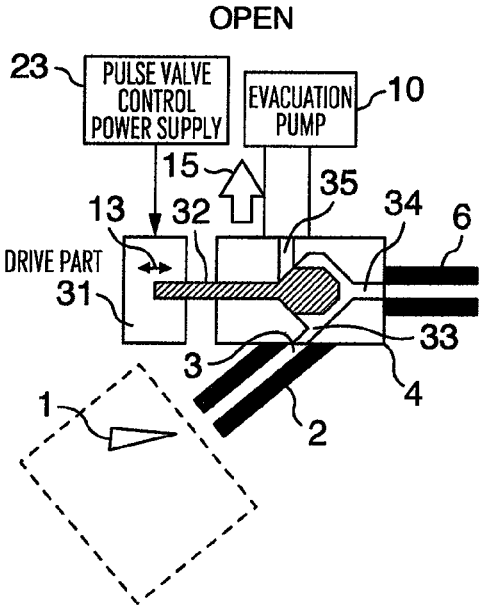
FIGS. 6A and 6B show a second embodiment of the present invention.
Figure 6B:
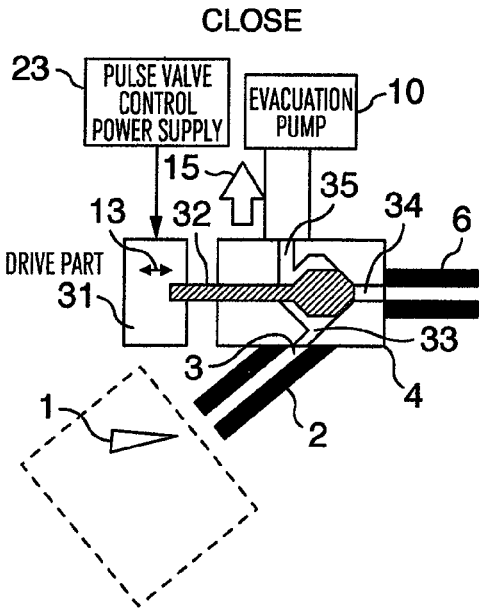

FIGS. 6A and 6B are configuration diagrams of the pulse valve in a second embodiment according to the present invention. A configuration of the analyzer 5 and its subsequent components and a measurement sequence are the same as those in the first embodiment. In the present embodiment, however, a tri-direction globe valve suitable for fast opening/closing operation is used as the pulse valve. In a movable space, there is an opening part to a valve-inlet side piping 33, a mass-spectrometry-part side piping 34, and a vacuum-evacuation side piping 35 and passage of a sample is controlled by movement of a movable seal part 32. FIG. 6A shows the configuration when the pulse valve 4 is open; a passage between the valve-inlet side piping 33 and the vacuum-evacuation side piping 35 is blocked and the valve-inlet side piping 33 is connected to the mass-spectrometry-part side piping 34. FIG. 6B shows the configuration when the pulse valve 4 is closed; the valve-inlet side piping 33 and the vacuum-evacuation side piping 35 are connected whereas a passage between the valve-inlet side piping 33 and the mass-spectrometry-part side piping 34 is blocked.

In the first embodiment, ions introduced into the pre-valve evacuation region 3 are ejected together with gas in the direction to the evacuation pump 10 even when the valve is open. As a result, there is a possibility that the ions introduced into the mass spectrometry part will decrease and the sensitivity will fall. In the present embodiment, ejection of ions to the evacuation pump 10 is prevented when the valve is open and there is an advantage that the sensitivity is improved as compared with the first embodiment. Furthermore, in the present embodiment, an angle formed by the valve-inlet side piping 33 and the mass-spectrometry-part side piping 34 is set greater than 90 degrees and less than 180 degrees so that collisions of ions with wall faces is reduced and the efficiency of passage through the pulse valve 4 can also be enhanced.

Third Embodiment

Figure 7A:
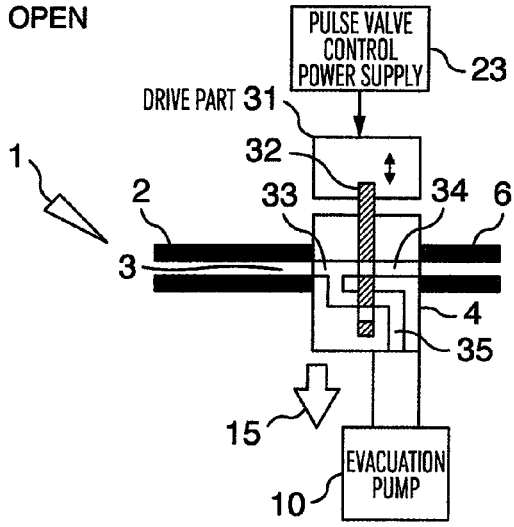
FIGS. 7A and 7B show a third embodiment of the present invention.
Figure 7B:
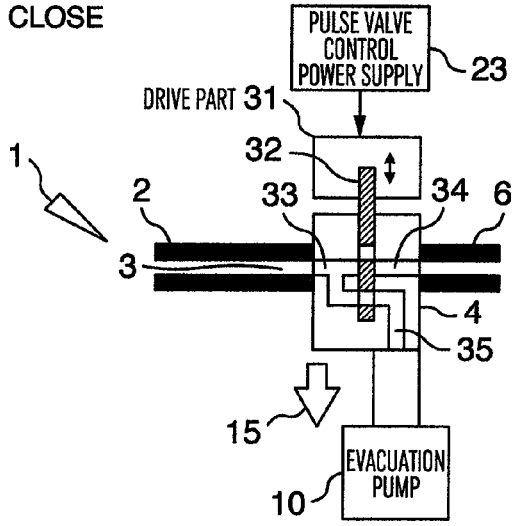

FIGS. 7A and 7B are configuration diagrams of the pulse valve in a third embodiment according to the present invention. A configuration of the analyzer 5 and its subsequent components and a measurement sequence are the same as those in the first embodiment. In the present embodiment, however, a tri-direction slide valve is used as the pulse valve. In a movable space, there is an opening part to a valve-inlet side piping 33, a mass-spectrometry-part side piping 34, and a vacuum-evacuation side piping 35 and passage of a sample is controlled by sliding a movable seal part 32 having holes as illustrated. As shown in FIG. 7A, only the valve-inlet side piping 33 and the mass-spectrometry-part side piping 34 are connected together when the pulse valve 4 is open. As shown in FIG. 7B, only the valve-inlet side piping 33 and the vacuum-evacuation side piping 35 are connected together when the pulse valve 4 is closed. This way of coupling is similar to that in the second embodiment and reduction of ions due to flow to the evacuation pump 10 can be prevented compared with the first embodiment. Furthermore, ions can move straight within the pulse valve by using the slide valve. As a result, it becomes possible to obtain a transmission efficiency which is remarkably high compared with the first and second embodiments. On the other hand, since the contact surface becomes larger than the global valve, the second embodiment is more desirable for fast operation with low power consumption.

Fourth Embodiment

Figure 8:
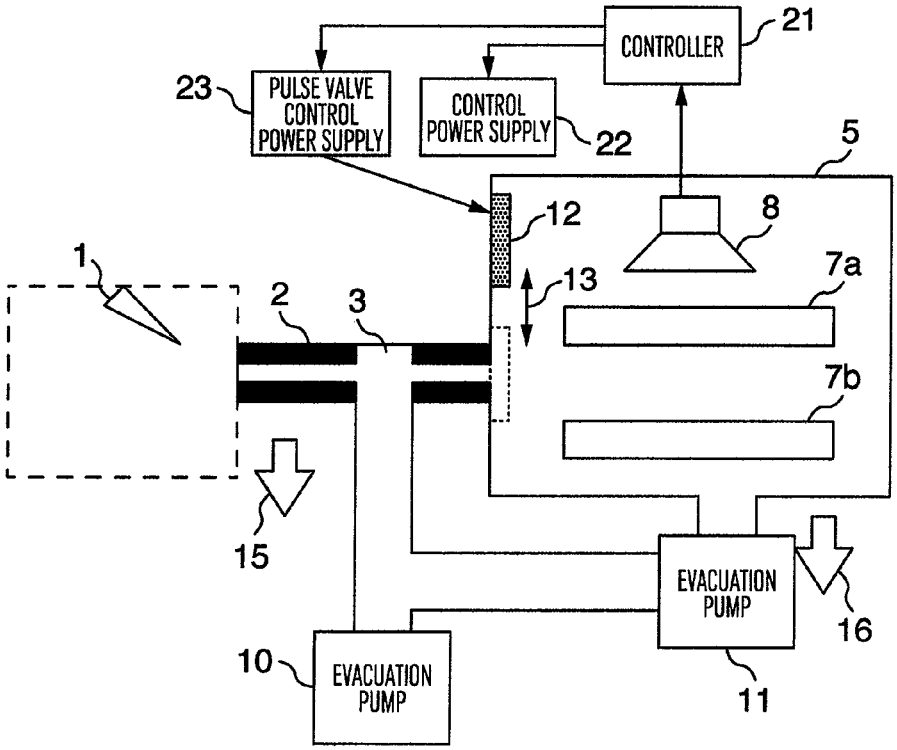
FIG. 8 shows a fourth embodiment of the present invention.

FIG. 8 is a configuration diagram of the pulse valve in a fourth embodiment according to the present invention. A configuration of the analyzer 5 and its subsequent components and a measurement sequence are the same as those in the first embodiment. In the present embodiment, however, a gate valve 12 is used as the pulse valve. In all of the globe valve and the slide valve in the first, second, and third embodiments, there is the movable seal part 32 in a part contiguous to ion trajectories when the pulse valve is open. If dirt sticks to the movable seal part 32, therefore, there is a possibility that the dirt will cause a memory effect as a noise signal over a long time. On the contrary, in the present embodiment, it is possible to improve the memory effect because the gate valve 12 is disposed in a part far from the ion trajectories when it is open. On the other hand, there is a problem in fast operation with low power consumption because the operation distance is longer than the globe valve or the slide valve.

Incidentally, in the present embodiment, evacuation of the backpressure side of a turbo molecular pump 11 which evacuates the analyzer 5 is conducted by an evacuation pump 10 which evacuates the pre-valve evacuation region 3. The number of pumps can be reduced and the cost and weight of the whole apparatus can be reduced by conducting such sharing. In this case, it is necessary to set the pressure of the pre-valve evacuation region 3 equal to 2,500 Pa or less, which is an allowable maximum backpressure of the turbo molecular pump 11. In order to manage both this condition and the ion transmission within the valve, the pressure in the pre-valve evacuation region 3 is set in a range of 100 Pa to 2,500 Pa. This method is not restricted to the present embodiment but can be applied to all other embodiments.

Fifth Embodiment

Figure 9:
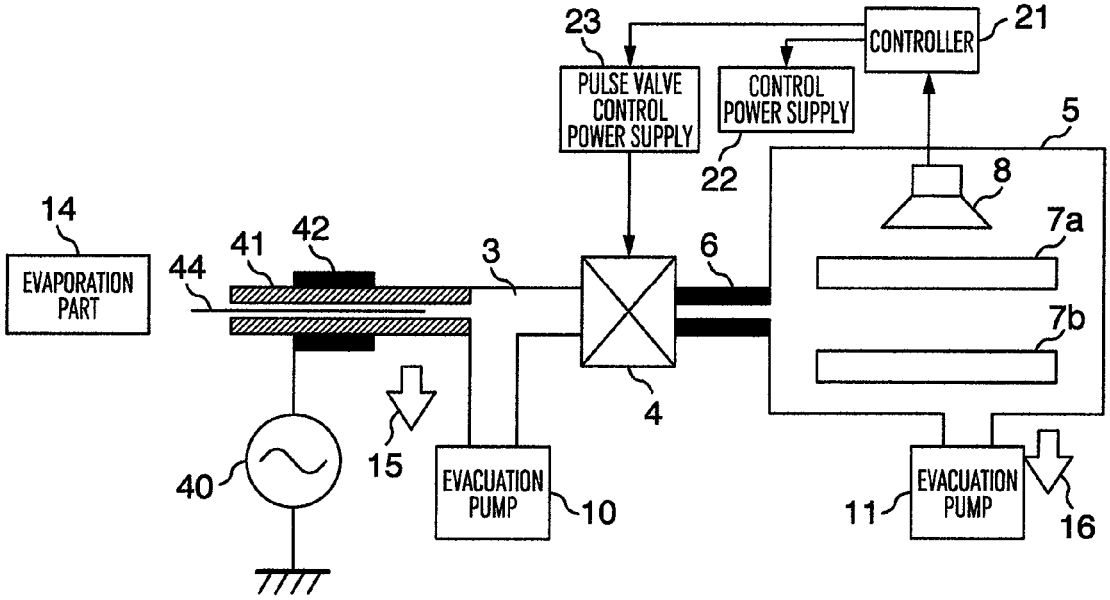
FIG. 9 shows a fifth embodiment of the present invention.

FIG. 9 is a configuration diagram of a fifth embodiment according to the present invention. A configuration of the analyzer 5 and its subsequent components and a measurement sequence are the same as those in the first embodiment. In the present embodiment, however, ionization using primary ions generated by low-vacuum barrier discharge, which can operate favorably in a low-vacuum region of approximately 300 to 30,000 Pa, as seed ions (hereinafter referred to as low-vacuum barrier-discharge ionization) is used for the ion source instead of the atmospheric-pressure ion source. When barrier discharge is conducted in the vacuum, there is a problem that fragment ions are generated at a pressure less than 300 Pa, resulting in a lowered sensitivity of molecular ions. Furthermore, at a pressure greater than 30,000 Pa, there is a disadvantage that it is necessary to use gas such as helium to sustain stable barrier discharge. Therefore, the pressure suitable for the low-vacuum barrier discharge is in the range of 300 Pa to 30,000 Pa. A part of the measurement object component is at least evaporated by an evaporation part 14 comprising a heater, a spray vaporizer, or the like. Evaporated molecules are introduced into a dielectric capillary 41 comprising a dielectric such as glass, ceramics, or plastics together with peripheral gas. The dielectric capillary 41 has an electrode 44 inserted therein. Furthermore, an electrode 42 is disposed outside the dielectric. Dielectric barrier discharge proceeds within the capillary by applying a voltage 40 having a frequency in the range of 1 to 100 kHz and a voltage in the range of approximately 2 to 5 kV between the electrodes 42 and 44. For the barrier discharge, it is necessary to use helium or the like in the atmospheric pressure. In a low-vacuum region having a pressure in the range of approximately 300 to 30,000 Pa, stable discharge is possible with the air as well. Ions of sample molecules are generated by introducing evaporated molecules into this discharge region. By the way, as for generated ions, they can be measured using an operation similar to that in the first embodiment and consequently its description will be omitted here. As for the low-vacuum barrier discharge, stable discharge can be conducted only in a narrow pressure range when the electrode shape and the applied voltage parameters are fixed. When the pressure varies remarkably like the first 10 ms in the conventional art example shown in FIG. 4A, therefore, the barrier-discharge ionization does not stabilize and it becomes impossible to combine the conventional art example with the low-vacuum barrier-discharge ionization. On the other hand, in the present embodiment, there is little pressure variation at 0.5 ms or longer after the valve is opened. It is appreciated that there is a great advantage when the present invention is combined with the low-vacuum barrier-discharge ionization.

Incidentally, in the present embodiment, the low-vacuum barrier-discharge ionization is described. For any ion source such as glow-discharge ionization installed in the same way in the range of 300 to 30,000 Pa, however, there is an advantage that the pressure variation is small and consequently variation of the ionization efficiency is small by utilizing the present invention. For obtaining the effects of the present invention in the present embodiment, the pre-valve evacuation region 3 is set in the range of 300 to 10,000 Pa.

Sixth Embodiment

Figure 10:
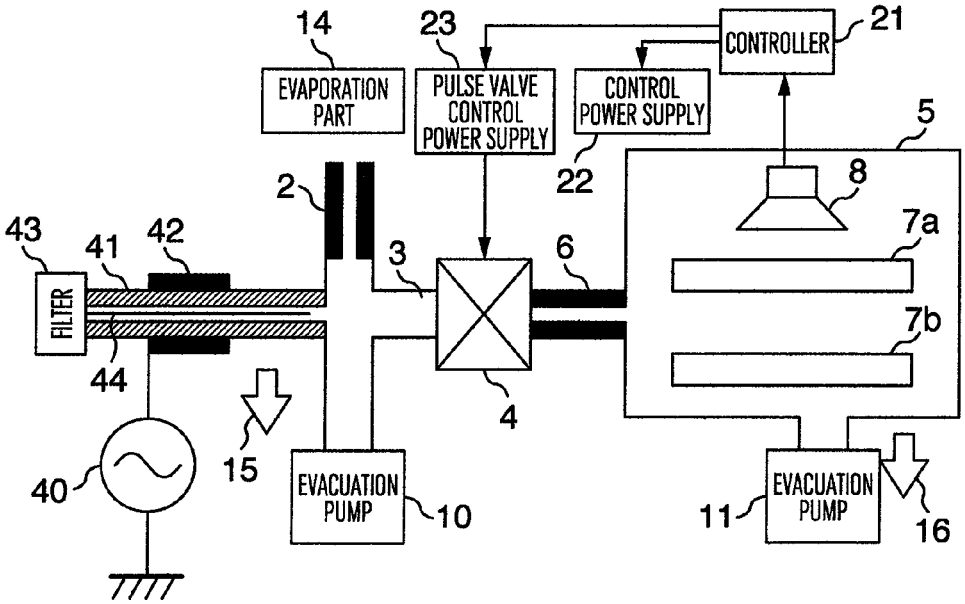
FIG. 10 shows a sixth embodiment of the present invention.

FIG. 10 is a configuration diagram of a sixth embodiment according to the present invention. A configuration of the analyzer 5 and its subsequent components and a measurement sequence are the same as those in the first embodiment and the low-vacuum barrier discharge is used in the same way as in the fifth embodiment. In the present embodiment, however, the capillary 2 for sample introduction is disposed separately from the barrier-discharge capillary 41 for seed ion generation. It is known that the low-vacuum barrier discharge becomes unstable with liquid or dust entering the discharge region. It is possible to stabilize the ionization by letting only gas with dirt removed by passing through a filter 43 flow into the dielectric capillary 41 separately from the sample introducing capillary 2. Especially when the solution sample or the like is sprayed and evaporated by electro-spray or the like, this method is effective because liquid drops are introduced into the vacuum. Gas molecules from the evaporation part 14 passing through the capillary 2 collide with seed ions supplied from the dielectric capillary 41 in the pre-valve evacuation region 3 and ionization proceeds.

By the way, in the present embodiment, low-vacuum barrier discharge is used to generate seed ions. For any seed ion generation method such as glow discharge or thermionic emission from a filament installed in the same way in the range of 300 to 30,000 Pa, however, there is an advantage that the pressure variation is small and consequently variation of the ionization efficiency is small by utilizing the present invention. For obtaining the effects of the present invention in the present embodiment, the pre-valve evacuation region 3 is set in the range of 300 to 10,000 Pa.

Seventh Embodiment

Figure 11:
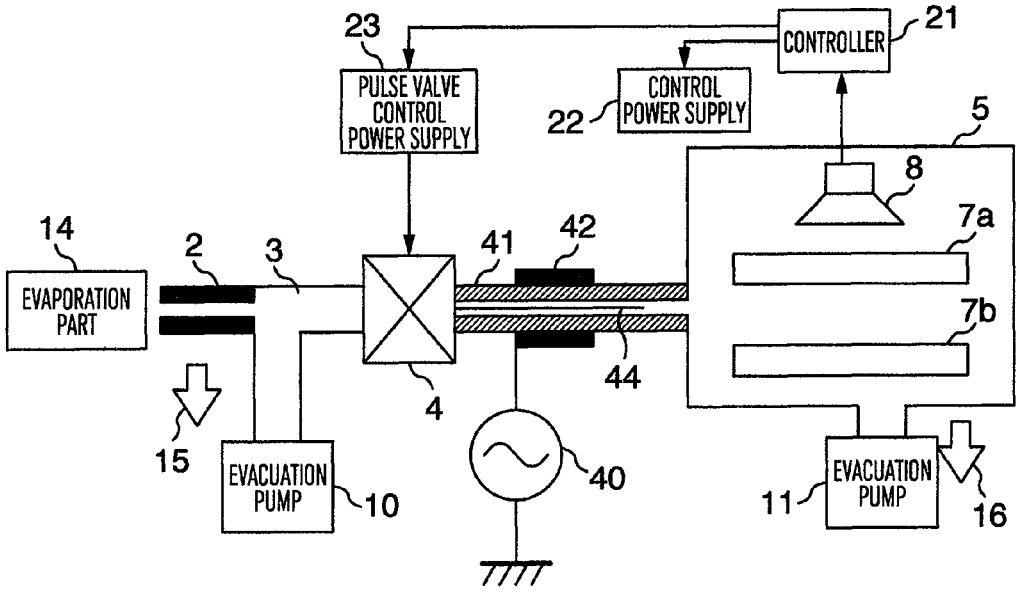
FIG. 11 shows a seventh embodiment of the present invention.

FIG. 11 is a configuration diagram of a seventh embodiment according to the present invention. A configuration of the analyzer 5 and its subsequent components and a measurement sequence are the same as those in the first embodiment and the low-vacuum barrier-discharge ionization is used in the same way as in the fifth embodiment. In the present embodiment, however, an ion source is disposed on the higher-vacuum side than the pulse valve 4. Dirt in the atmospheric pressure is not introduced unless the pulse valve is open and, compared with the fifth embodiment, it becomes possible to improve the durability remarkably.

Incidentally, in the present embodiment, the low-vacuum barrier-discharge ionization is described. For any ion source such as glow discharge ionization installed in the same way in the range of 300 to 30,000 Pa, however, there is an advantage that the pressure variation is small and consequently variation of the ionization efficiency is small by utilizing the present invention. For obtaining the effects of the present invention in the present embodiment, the pre-valve evacuation region 3 is set in the range of 300 to 10,000 Pa.

Eighth Embodiment

Figure 12:
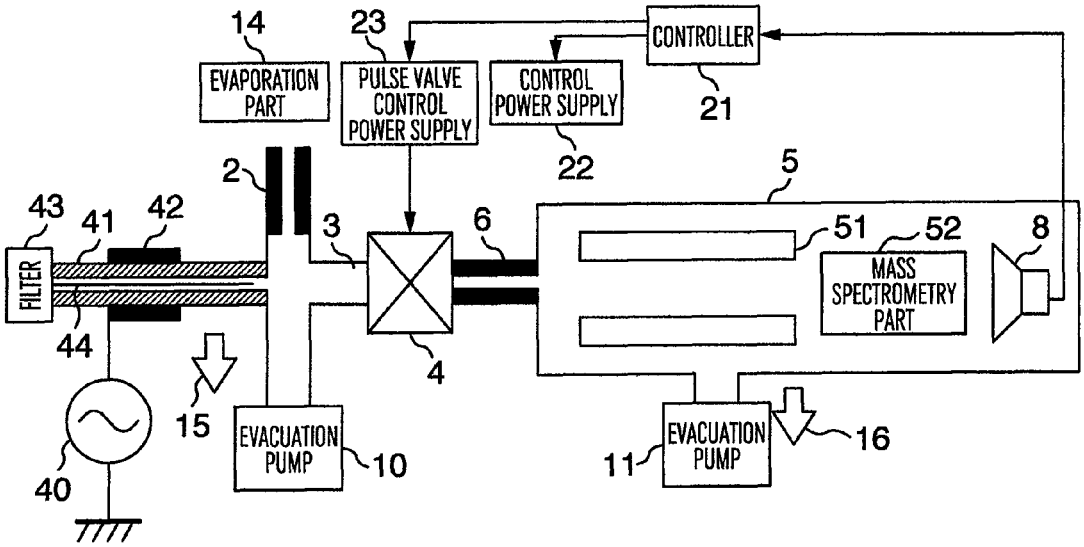
FIG. 12 shows an eighth embodiment of the present invention.

FIG. 12 is a configuration diagram of an eighth embodiment according to the present invention. Parts such as the ion source and the pulse valve 4 other than the analyzer 5 are the same as those in the sixth embodiment. In the present embodiment, however, ions are stored not in the mass spectrometry part but in a pre-trap 51 and mass isolation is conducted in a mass spectrometry part 52 which is separated from the pre-trap 51. As the mass spectrometry part, mass spectrometers of various types such as a triple quadrupole mass spectrometer, a time-of-flight mass spectrometer, an electric field Fourier transform mass spectrometer (Orbitrap), a Fourier transform ion cyclotron resonance mass spectrometer, and an electric-field magnetic-field double-focusing mass spectrometer can be used. While in FIG. 12 the pre-trap 51 and the mass spectrometry part 52 are disposed in the same vacuum chamber, it is suitable for a mass spectrometry part which requires a high vacuum if the mass spectrometry part is disposed in a different vacuum chamber. Incidentally, in the present embodiment, an example using the low-vacuum barrier-discharge ionization is described. However, it is possible to combine the present embodiment with an ion source and ion introducing method in any of the first to seventh embodiments.

Besides, in common to the embodiments described heretofore, examples in which a specific linear ion trap is used in the mass spectrometry part and the pre-trap have been described. Even when any ion trap having a trap action, such as a linear ion trap of a different kind, a 3-dimensional quadrupole ion trap, a cylindrical ion trap, or a multipole ion guide, is used, however, the present invention brings about similar effects.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A mass spectrometer comprising:

a mass spectrometry part for conducting mass spectrometry on a sample gas;

a sample gas introducing piping part for introducing a sample gas into said mass spectrometry part;

an opening/closing mechanism disposed between said sample gas introducing piping part and said mass spectrometry part to open/close thereby to control passage of said sample gas;

an opening/closing control part for controlling said opening/closing mechanism;

a first pump for evacuating for a side region of said opening/closing mechanism opposite to said mass spectrometry part;

an evacuation pipe for connecting said first pump and said sample gas introducing piping part together; and an ion source disposed on a side region of said opening/closing mechanism which is the same as said mass spectrometry part and which converts said sample gas into ions.

2. The mass spectrometer according to claim 1, wherein said opening/closing control part controls the opening/closing mechanism to open said sample gas introducing piping part for a sample gas accumulation period of said mass spectrometry part and close said sample gas introducing piping part for other periods.

3. The mass spectrometer according to claim 1, wherein said first evacuation pump evacuates the side region of said opening/closing mechanism for said sample gas introducing piping part opposite to said mass spectrometry part to have a pressure of 1,000 Pa or greater.

4. The mass spectrometer according to claim 1, wherein said sample gas introducing piping part comprises any one of a capillary, an orifice, and a vacuum chamber, or a plurality of any of them.

5. The mass spectrometer according to claim 1, wherein said evacuation pipe is provided between a sample gas introduction inlet of said sample gas introducing piping part and said opening/closing mechanism.

6. The mass spectrometer according to claim 1, wherein:

said opening/closing mechanism comprises a movable member and a movable space for said movable member; and said movable space comprises an opening part to said sample gas introducing piping part and an opening part to said mass spectrometry part.

7. The mass spectrometer according to claim 6, wherein:

said movable space comprises an opening part to said evacuation pipe;

said opening/closing control part controls said movable member, when passing said sample gas, to close a passage between said opening part to said sample gas introducing piping part and said opening part to said evacuation pipe and open a passage between said opening part to said sample gas introducing piping part and said opening part to said mass spectrometry part, and said opening/closing control part controls said movable member, when not passing said sample gas, to close a passage between said opening part to said sample gas introducing piping part and said opening part to said mass spectrometry part and open a passage between said opening part to said sample gas introducing piping part and said opening part to said evacuation pipe.

8. The mass spectrometer according to claim 6, wherein a direction from said movable space to said opening part to said sample gas introducing piping part and a direction from said movable space to said opening part to said mass spectrometry part form an angle which is greater than 90° and which is 180° or less.

9. The mass spectrometer according to claim 1, wherein said opening/closing mechanism is an opening/closing gate provided between said sample gas introducing piping part and said mass spectrometry part.

10. The mass spectrometer according to claim 1, wherein said mass spectrometry part comprises a second evacuation pump for evacuation, and said second evacuation pump is coupled to said evacuation pipe and a backpressure side of said second evacuation pump is evacuated by said first evacuation pump.

11. The mass spectrometer according to claim 10, wherein said first evacuation pump evacuates the side region of said opening/closing mechanism for said sample gas introducing piping part opposite to said mass spectrometry part to have a pressure of 100 Pa or greater and 2,500 Pa or less.

12. The mass spectrometer according to claim 1, further comprising a pre-trap part for trapping said sample gas introduced into said mass spectrometry part.

* * * * *